US009120109B2

(12) United States Patent
Gañan-Calvo et al.

(10) Patent No.: US 9,120,109 B2
(45) Date of Patent: Sep. 1, 2015

(54) NOZZLE INSERT DEVICE AND METHODS FOR DISPENSING HEAD ATOMIZER

(75) Inventors: Alfonso M. Gañan-Calvo, Seville (ES); Miguel A. Asensio-Caño, Bormujos (ES); Alvaro Fito-Planas, Seville (ES); Jorge Lopez-Serrano, Coria del Rio (ES); Javier Perez-Vaquero, Los Palacios (ES); Jeffrey Badovick, Ormond Beach, FL (US)

(73) Assignee: Universidad de Sevilla (ES)

( * ) Notice: Subject to any disclaimer, the term of this patent is extended or adjusted under 35 U.S.C. 154(b) by 518 days.

(21) Appl. No.: 13/408,667

(22) Filed: Feb. 29, 2012

(65) Prior Publication Data

US 2013/0221122 A1 Aug. 29, 2013

(51) Int. Cl.

| | |
|---|---|
| ***B05B 7/04*** | (2006.01) |
| ***B05B 7/12*** | (2006.01) |
| ***B65D 83/44*** | (2006.01) |
| ***B65D 83/14*** | (2006.01) |
| *B05B 15/02* | (2006.01) |

(52) U.S. Cl.

CPC ..... *B05B 7/0475* (2013.01); *B05B 7/1245* (2013.01); *B65D 83/44* (2013.01); *B65D 83/7532* (2013.01); *B05B 15/02* (2013.01)

(58) Field of Classification Search

CPC .... B05B 7/0475; B05B 7/1245; B65D 83/44; B65D 83/7532

USPC ..... 239/8, 311, 314, 337, 372, 408, 416.5; 222/402.18

See application file for complete search history.

(56) References Cited

U.S. PATENT DOCUMENTS

| | | | |
|---|---|---|---|
| 2,887,273 | A | 5/1959 | Anderson et al. |
| 4,369,900 | A | 1/1983 | Saito et al. |

(Continued)

FOREIGN PATENT DOCUMENTS

| | | |
|---|---|---|
| DE | 6603734 | 2/1967 |
| EP | 0008109 | 11/1983 |

(Continued)

OTHER PUBLICATIONS

International Search Report and Written Opinion, dated Jun. 14, 2013, related to International Application No. PCT/US2013/028424, 9 pages.

(Continued)

*Primary Examiner* — Ryan Reis

(74) *Attorney, Agent, or Firm* — Lucian Wayne Beavers; Patterson Intellectual Property Law, PC

(57) ABSTRACT

A dispensing head for emitting an atomized spray of liquid droplets includes an actuator and a nozzle insert. The actuator includes a gas duct and a liquid duct and may be attached to a container housing a propellant gas and a liquid product. The nozzle insert includes at least one modular structure that can be installed in an actuator socket on the actuator. The nozzle insert includes a pressure cap defining a pressure chamber having an exit orifice. A liquid conduit is disposed in the pressure chamber and defines a liquid supply channel having a liquid supply channel exit opening. The nozzle insert is configured to form a reflux cell in the liquid supply channel upstream of the liquid supply channel exit opening to achieve flow blurring interaction between the liquid product and the gas propellant.

15 Claims, 11 Drawing Sheets

(56) References Cited

U.S. PATENT DOCUMENTS

| | | | | | |
|---|---|---|---|---|---|
| 4,396,152 | A | * | 8/1983 | Abplanalp | 239/337 |
| 4,431,119 | A | * | 2/1984 | Stoody | 222/129 |
| 4,437,588 | A | | 3/1984 | Shay | |
| 5,110,052 | A | * | 5/1992 | Graf et al. | 239/333 |
| 5,125,546 | A | | 6/1992 | Dunne et al. | |
| 5,139,201 | A | | 8/1992 | De Laforcade | |
| 5,323,935 | A | * | 6/1994 | Gosselin et al. | 222/401 |
| 5,397,059 | A | * | 3/1995 | Baudin | 239/333 |
| 5,429,279 | A | | 7/1995 | Van Der Heijden | |
| 5,649,649 | A | | 7/1997 | Marelli | |
| 5,697,530 | A | | 12/1997 | Montaner et al. | |
| 6,347,899 | B1 | | 2/2002 | Vierboom | |
| 6,394,364 | B1 | * | 5/2002 | Abplanalp | 239/354 |
| 7,487,891 | B2 | | 2/2009 | Yerby et al. | |
| 7,854,353 | B2 | | 12/2010 | Schmitz et al. | |
| 2004/0112923 | A1 | | 6/2004 | Tsutsui | |
| 2005/0103811 | A1 | | 5/2005 | Heukamp | |
| 2008/0035678 | A1 | | 2/2008 | Lee | |
| 2008/0271350 | A1 | | 11/2008 | Ganan-Calvo | |

FOREIGN PATENT DOCUMENTS

| | | | |
|---|---|---|---|
| JP | 07330051 | A | 12/1995 |
| JP | 2005132087 | A | 5/2005 |
| JP | 2005206158 | A | 8/2005 |
| JP | 2011177677 | A | 9/2011 |

OTHER PUBLICATIONS

International Search Report and Written Opinion, dated Jun. 14, 2013, related to International Application No. PCT/US2013/028443, 9 pages.

International Search Report and Written Opinion, dated Jun. 14, 2013, related to International Application No. PCT/US2013/028461,11 pages.

* cited by examiner

NOZZLE INSERT DEVICE AND METHODS FOR DISPENSING HEAD ATOMIZER

BACKGROUND

1. Technical Field

The present invention relates generally to nozzle devices and methods for creating atomized sprays and more particularly to modular nozzle insert devices for use in dispensing head atomizers on liquid product containers.

2. Background Art

Devices for dispensing liquids are generally known in the art. Such conventional devices include generally include a container for storing a liquid product and a means for ejecting the liquid product from the container through a dispensing head or a nozzle. Such conventional delivery means often include a reservoir of pressurized gas stored in the container. The pressurized gas serves as a propellant for forcing the liquid product out of the container.

Such conventional devices often include a dispenser head including a depressible pump or actuator for manual manipulation by a user. By depressing the dispenser head, a user may selectively open a valve or other mechanism that allows the pressurized gas, or gas propellant, to force the liquid product through the valve and out of the dispensing head for application or use. Such conventional devices are commonly used to store and dispense a liquid product that is a cosmetic product. A cosmetic product, or a cosmetic liquid, may be referred to as a hair spray, a deodorant, a foam, a gel, a coloring spray, a sunscreen, a skin care agent, a cleaning agent or the like.

In some applications, it is generally desirable to provide a dispensing device for a liquid product, such as a cosmetic product, that achieves an atomized spray of the liquid product upon ejection from the dispensing device. Generally, it is preferable to provide an atomized spray of fine particles that are relatively small and uniformly sized. Conventional dispensing devices for delivery of cosmetic products are inadequate because such devices do not provide a uniform dispersion of atomized particles having optimal small sizes. Instead, conventional dispensing devices often provide atomized liquid dispersions or sprays that include non-uniformly sized particles.

Another problem associated with conventional dispensing devices for cosmetic products includes clogging of the channels in the dispensing device. For example, it is generally known in the art that atomized sprays can be generated to include smaller particles by providing smaller diameter orifice at a spray nozzle exit. However, by reducing the dimensions of the spray nozzle exit, the more likely it is that the exit orifice will become clogged by the cosmetic product. This is especially true for liquid products that have adherent properties, such as cosmetic products, hair sprays, skin sprays, fragrance sprays, deodorant sprays, paints, glues, pesticides, etc.

What is needed then are improvements in dispensing heads and nozzle devices and methods for delivery of liquid products in the form of atomized sprays.

BRIEF SUMMARY

The present disclosure provides a dispensing head and a nozzle insert apparatus and associated methods for providing an atomized spray of gas and liquid.

A further object of the present disclosure is to provide a dispensing head apparatus for ejecting an atomized spray from a container. The dispensing head may include a separate part that can be attached to a container storing a liquid product. The dispensing head includes an actuator having a liquid duct, a gas duct, and an actuator socket defined in the actuator. The actuator socket is in fluid communication with the gas duct. A liquid conduit is disposed in the actuator socket. The liquid conduit includes a liquid supply channel in fluid communication with the liquid duct at one end and forming a liquid supply channel exit opening at the opposite end such that liquid travelling from the liquid duct toward the liquid supply channel exit opening passes through the liquid supply channel. A pressure cap is disposed in the actuator socket. The pressure cap defines a pressure chamber between the pressure cap and the liquid conduit. The pressure chamber is in fluid communication with the gas duct. A pressure chamber exit orifice is defined in the pressure cap downstream of the of the liquid supply channel exit opening such that gas passing from the gas duct through the pressure chamber toward the pressure chamber exit orifice travels between the liquid supply channel exit opening and the pressure cap interior end wall.

A further object of the present disclosure is to provide a nozzle insert apparatus for insertion into an actuator on a dispenser head on a fluid product dispensing device. The nozzle insert includes a modular construction that can be assembled by combining multiple parts. The nozzle insert includes a pressure cap defining an interior pressure chamber. The pressure cap includes an interior pressure chamber end wall disposed at an axial end of the pressure cap and including a pressure chamber exit orifice defined in the interior pressure chamber end wall, the pressure chamber exit orifice having a diameter D. A liquid conduit member is disposed in the pressure chamber. The liquid conduit includes an axial liquid supply channel defined through the liquid conduit. The liquid supply channel terminates at a liquid supply channel exit opening. An axial gap is defined between the liquid supply channel exit opening and the interior pressure chamber end wall such that the liquid supply channel exit opening is axially offset from the interior pressure chamber end wall by an axial distance H.

Another object of the invention is to provide a device and associated methods for atomizing a liquid product. The device includes a nozzle coupled to a reservoir. The nozzle includes a liquid feeding tube having an exit opening and a pressure chamber surrounding the exit opening of the liquid feeding tube. The pressure chamber includes a pressure chamber exit orifice positioned downstream of the liquid feeding tube exit opening. During use, an atomized spray of a liquid product may be ejected from the nozzle by first forcing a gas through the pressure chamber and out the pressure chamber exit orifice and subsequently allowing the liquid product to travel through the liquid feeding tube such that liquid from the liquid feeding tube interacts with the gas and is ejected from the pressure chamber exit orifice in the form of an atomized spray. Once a desired amount of liquid product has been dispensed, the flow of the liquid product through the liquid feeding tube may be stopped, while the flow of gas through the pressure chamber and out of the exit orifice is temporarily maintained such that the space between the liquid feeding tube and the pressure chamber exit orifice is cleared of any residual liquid product. The flow of gas is then stopped, and the ejection of liquid product is complete.

Another object of the present disclosure is to provide a method of ejecting an atomized spray of a gas propellant and a liquid product from a dispensing head on a dispensing device. The method includes the steps of: (a) providing an actuator having a liquid duct, a gas duct and an actuator socket; (b) providing a pressure cap disposed in the axial socket, the pressure cap forming a pressure chamber between the pressure cap and the actuator and including a pressure chamber exit orifice defined in the pressure cap, wherein the pressure chamber is in fluid communication with the gas duct; (c) providing a liquid conduit in the pressure chamber between the pressure cap and the actuator, the liquid conduit including a liquid supply channel defined therein, the liquid supply channel including a liquid supply channel axis and including a liquid supply channel exit opening substantially aligned with the pressure chamber exit orifice; (d) supplying a flow of liquid through the liquid supply channel toward the liquid supply channel exit opening; (e) supplying a flow of a gas from the gas duct through the pressure chamber toward the liquid supply channel axis between the liquid supply channel exit opening and the pressure chamber exit orifice, wherein the gas intercepts the flow of liquid, travels upstream toward the liquid supply channel exit opening and enters the liquid supply channel exit opening; (f) forming a reflux cell inside the liquid supply channel upstream of the liquid supply channel exit opening, wherein the liquid and the gas undergo turbulent mixing in the reflux cell; and (g) ejecting the liquid from the reflux cell through the pressure chamber exit orifice.

Numerous other objects, advantages and features of the present invention will be readily apparent to those of skill in the art upon a review of the following drawings and description of a preferred embodiment of the invention.

DETAILED DESCRIPTION

Figure 1:
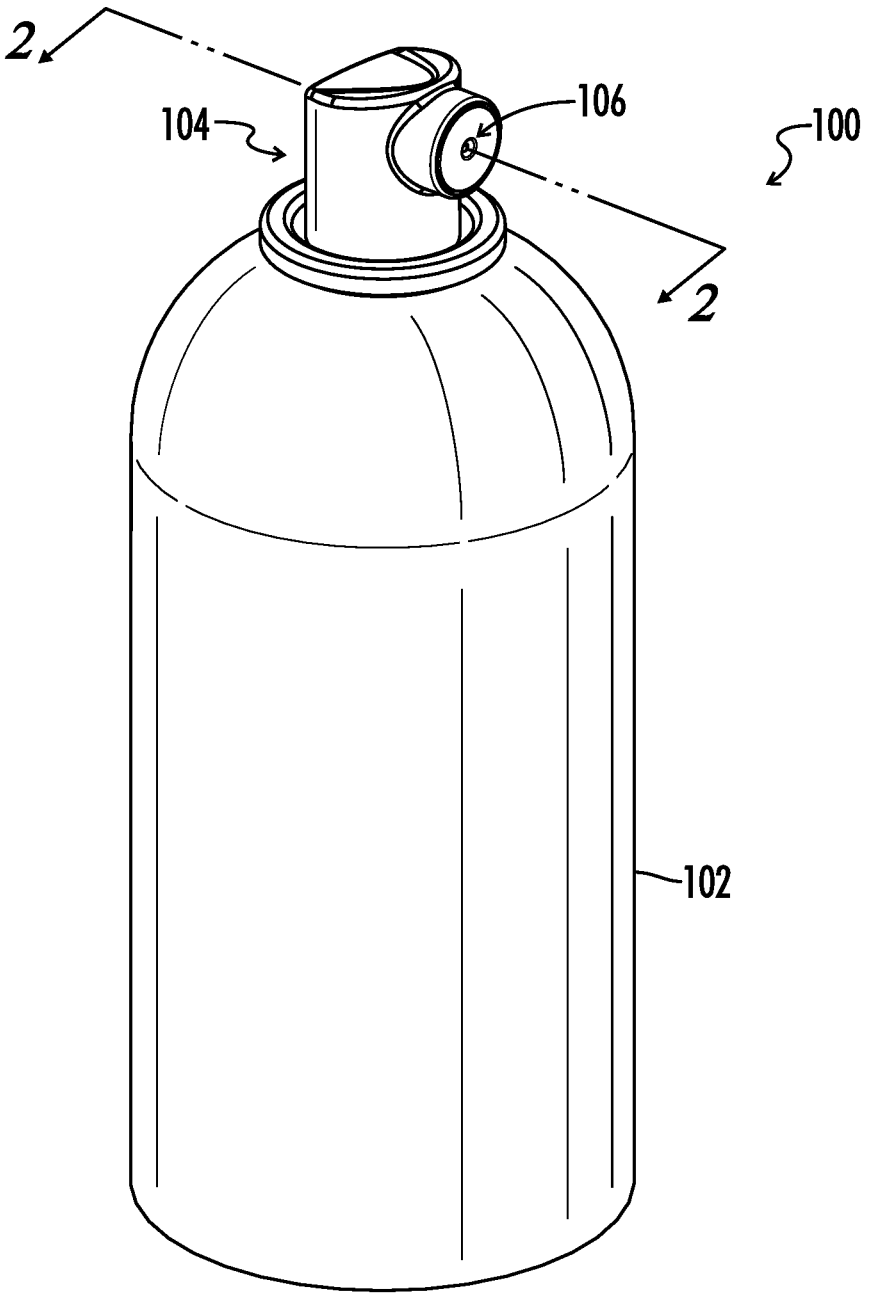
FIG. 1 illustrates a perspective view of an embodiment of a dispensing device in accordance with the present disclosure.

Referring now to the drawings, FIG. 1 illustrates an embodiment of a dispensing device 100. Dispensing device 100 generally includes a container 102 attached to a dispensing head 104. Dispensing head 104 includes an ejection opening 106 from which a liquid product stored in container 102 may be dispensed, or ejected. During use, a user may depress dispensing head 104 relative to container 102 to cause the liquid product stored in container 102 to be ejected from dispensing head 104 and more particularly from an ejection opening 106 on dispensing head 104.

Although the figures illustrate an embodiment of a dispensing device including spray direction oriented at a right angle relative to the actuation direction of the dispensing head, other embodiments not illustrated encompassed within the scope of the present invention include spray directions that are oriented at other angles relative to the actuation direction. For example, in additional embodiments, the device is configured to spray an atomized liquid product at any angle relative to the actuation direction of the dispensing head or parallel with the direction of actuation of the dispensing head.

Figure 2:
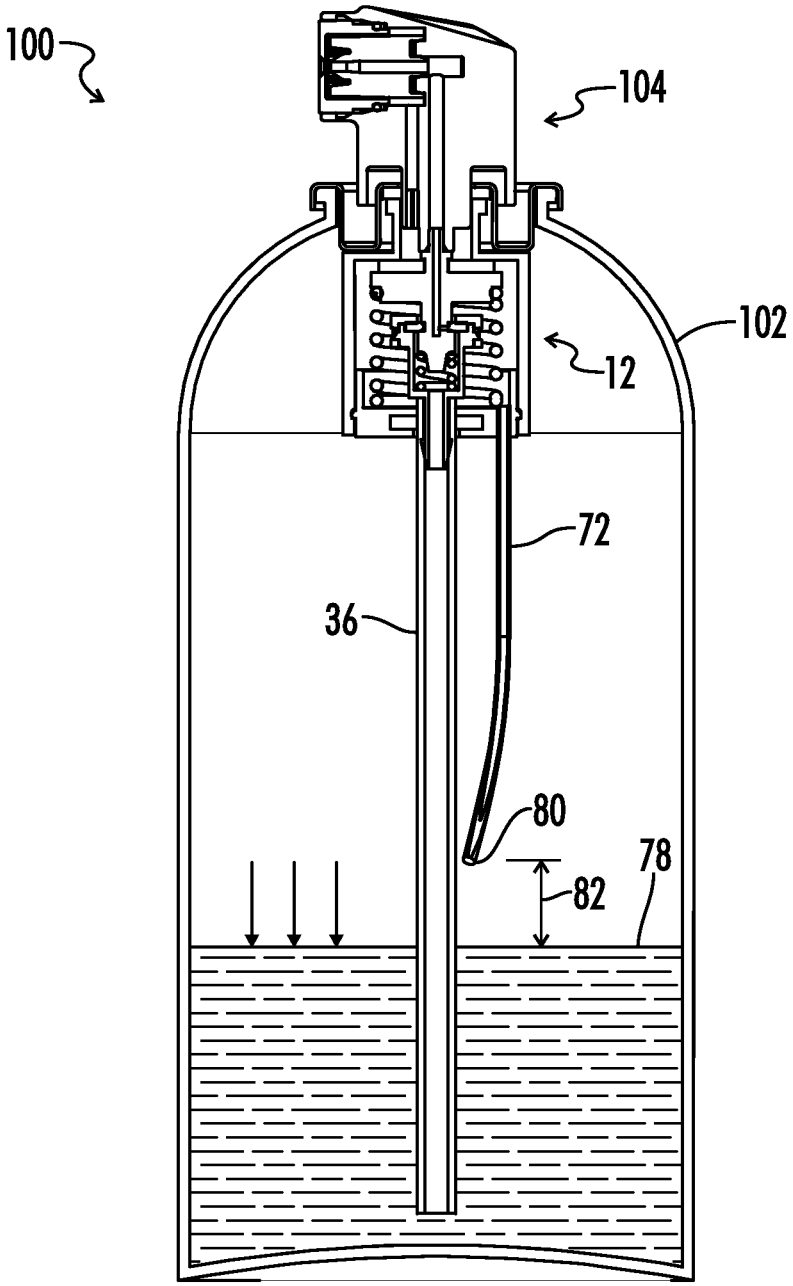
FIG. 2 illustrates a partial cross-sectional view of Section 2-2 of the dispensing device of FIG. 1.
Figure 3:
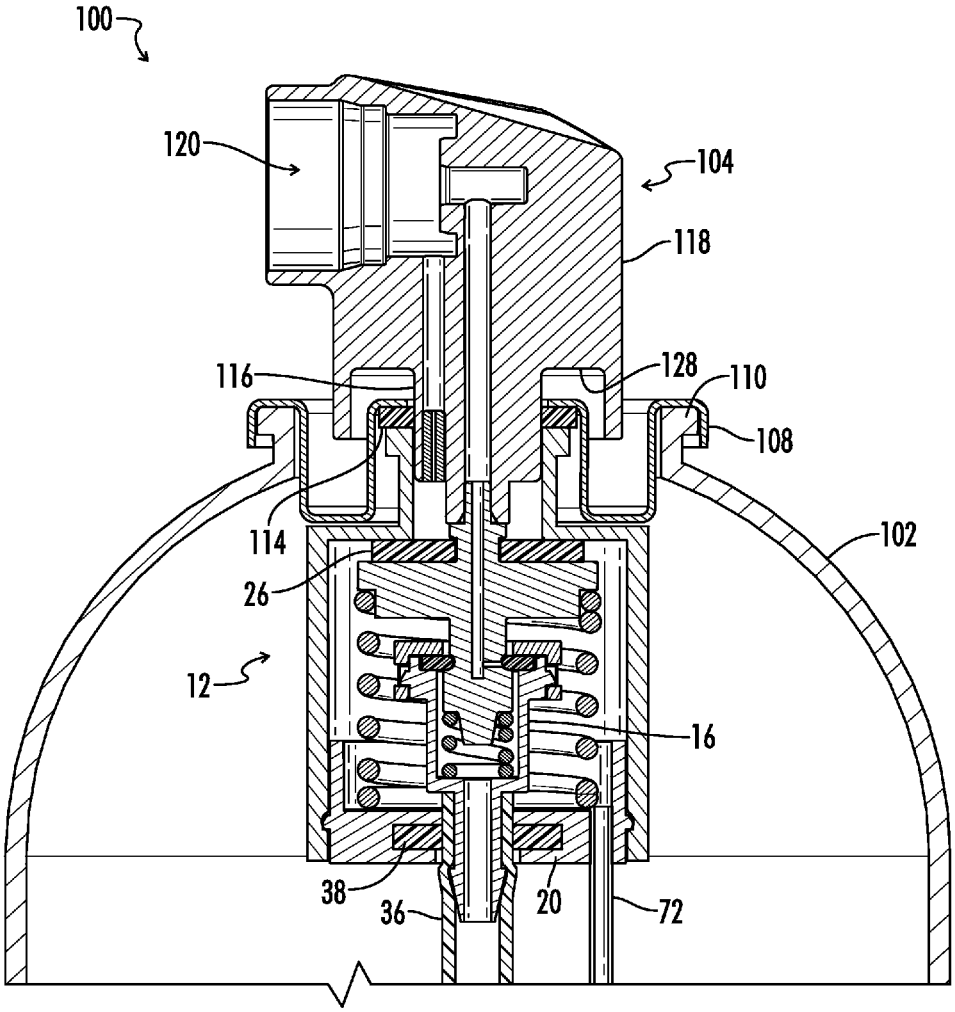
FIG. 3 illustrates a detail partial cross-sectional view of the embodiment of a dispensing device of FIG. 1 showing a sequential delivery valve in a closed position.

Referring now to FIG. 2 and FIG. 3, a partial cross-sectional view of Section 2-2 from FIG. 1 illustrates an embodiment of a dispensing device 100. Dispensing head 104 may be attached to container 102 via a collar 108. Collar 108 engages container rim 110 to secure collar 108 onto container 102. Collar 108 may be attached to container 102 using any suitable engagement, including a threaded fit, a press fit or interference fit, or a mechanical deformation fit such as crimping the outer edge of collar 108 against container rim 110 in some embodiments. Collar 108 generally forms a gas-tight seal between dispensing head 104 and container 102. As such, container 102 may form a pressure vessel for storing a pressurized propellant gas and a liquid product to be dispensed through dispensing head 104.

Figure 4:
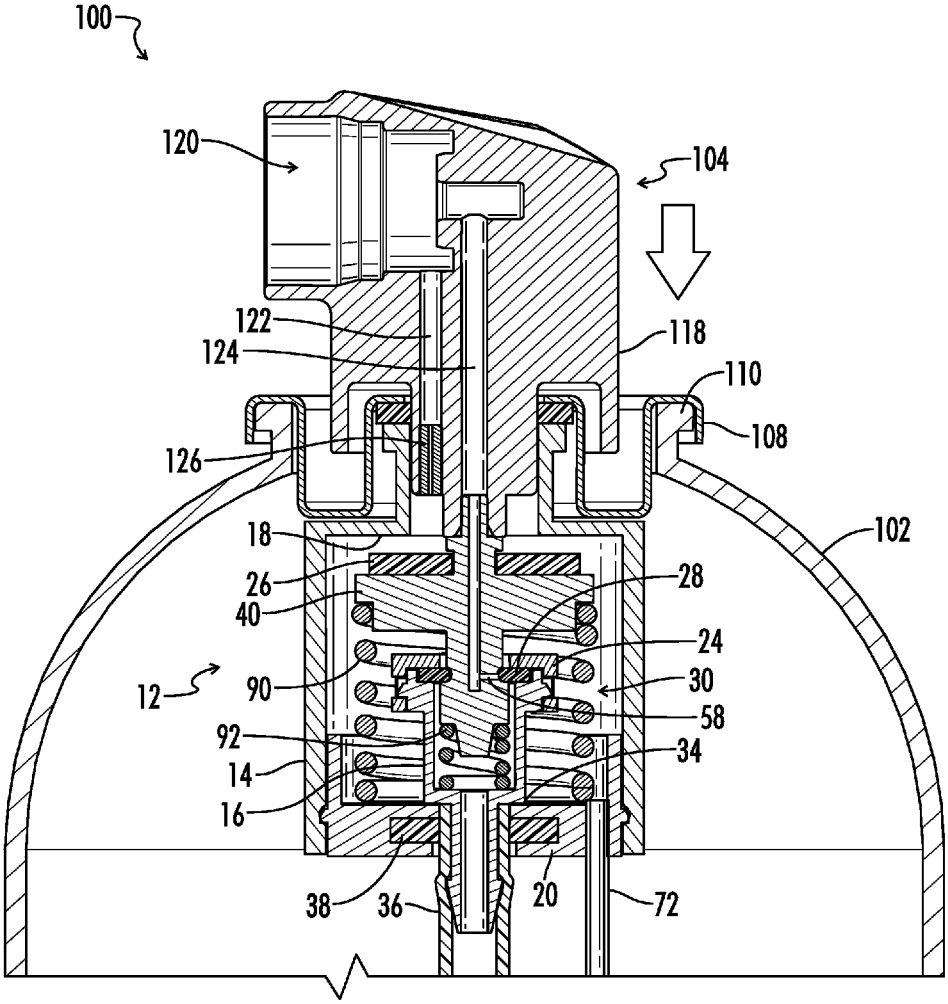
FIG. 4 illustrates a detail partial cross-sectional view of the embodiment of a dispensing device of FIG. 1 showing a sequential delivery valve in a partially open position.

During use, a user may manually depress dispensing head 104 along an actuation direction, indicated by the arrow in FIG. 4, to cause a liquid and a gas stored in container 102 to be expelled from dispensing head 104.

Dispensing head 104 includes an actuator 118. Actuator 118 generally forms a region of dispensing head 104 that a user manually engages with one or more of the user's fingers in some embodiments. An actuator stem 116 extends from the actuator 118 through the collar opening, as seen in FIG. 3. Actuator stem 116 may slidably travel through the collar opening in a slidable seal configuration. A stem seal 114 may be disposed between actuator stem 116 and collar 108 to provide a gas-tight seal therebetween. Stem seal 114 may include any suitable sealing material. In some embodiments, stem seal 114 is an annular ring or washer including an inner diameter slightly smaller than the outer diameter of actuator stem 116 such that stem seal 114 engages actuator stem 116 in a sliding interference fit. As such, pressurized gas may be retained in container 102 even when actuator 118 is moved relative to container 102.

A valve 12 is attached to actuator 118. In some embodiments, valve 12 may be referred to as a sequential delivery valve. Valve 12 may be attached to collar 108 or container 102 in some embodiments. As seen in FIG. 2 and FIG. 3, in some embodiments, valve 12 is positioned inside container 102 and operates to allow liquid stored in container 102 to enter dispensing head 104 when valve 12 is fully opened and to prevent liquid stored in container 102 from entering dispensing head 104 when valve 12 is closed.

As seen in FIG. 2, valve 12 may be positioned in container 102 in some embodiments above a liquid 78 stored in container 102. Liquid 78 includes a liquid product, such as a cosmetic liquid, for intended use. A liquid tube 36 extends between liquid 78 and a liquid port 86 on valve 12, seen in FIG. 6. Liquid tube 36 may attach to a liquid port fitting 84 extending downward from valve 12 in some embodiments.

Liquid port fitting 84 may include a barb shape for securing liquid tube 36 in an interference fit. Liquid tube 36 allows liquid 78 to enter valve 12.

A pressurized gas may be stored in container 102 above liquid 78. The pressurized gas may form a gas propellant for forcing liquid 78 upwards through liquid tube 36 and may include a single gas or a gas mixture. A gas tube 72 also extends downward from valve 12. Gas tube 72 allows gas stored in container 102 to enter valve 12. Gas tube 72 may be inserted in a gas port 88 on valve 12 in an interference fit in some embodiments. In other embodiments, gas tube 72 may be attached to a gas tube fitting extending from or attached to valve 12.

In some embodiments, as seen in FIG. 2, liquid tube 36 is longer than gas tube 72, or extends a greater distance below valve 12 than gas tube 72. As such, liquid tube 36 extends into liquid 78 when dispensing device 100 is in an upright position, while gas tube 72 does not extend into liquid 78 but instead terminates at a gas tube opening 80 positioned above liquid 78, thereby forming a gas tube opening offset distance 82 defined as the distance between the upper surface of the liquid 78 and the gas tube opening 80 when the container 102 is substantially level.

In some embodiments, the depth of liquid 78 and the dimensions of container 102 and gas tube 72 are such that gas tube opening 80 does not contact liquid 78 in any orientation of container 102.

Figure 6:
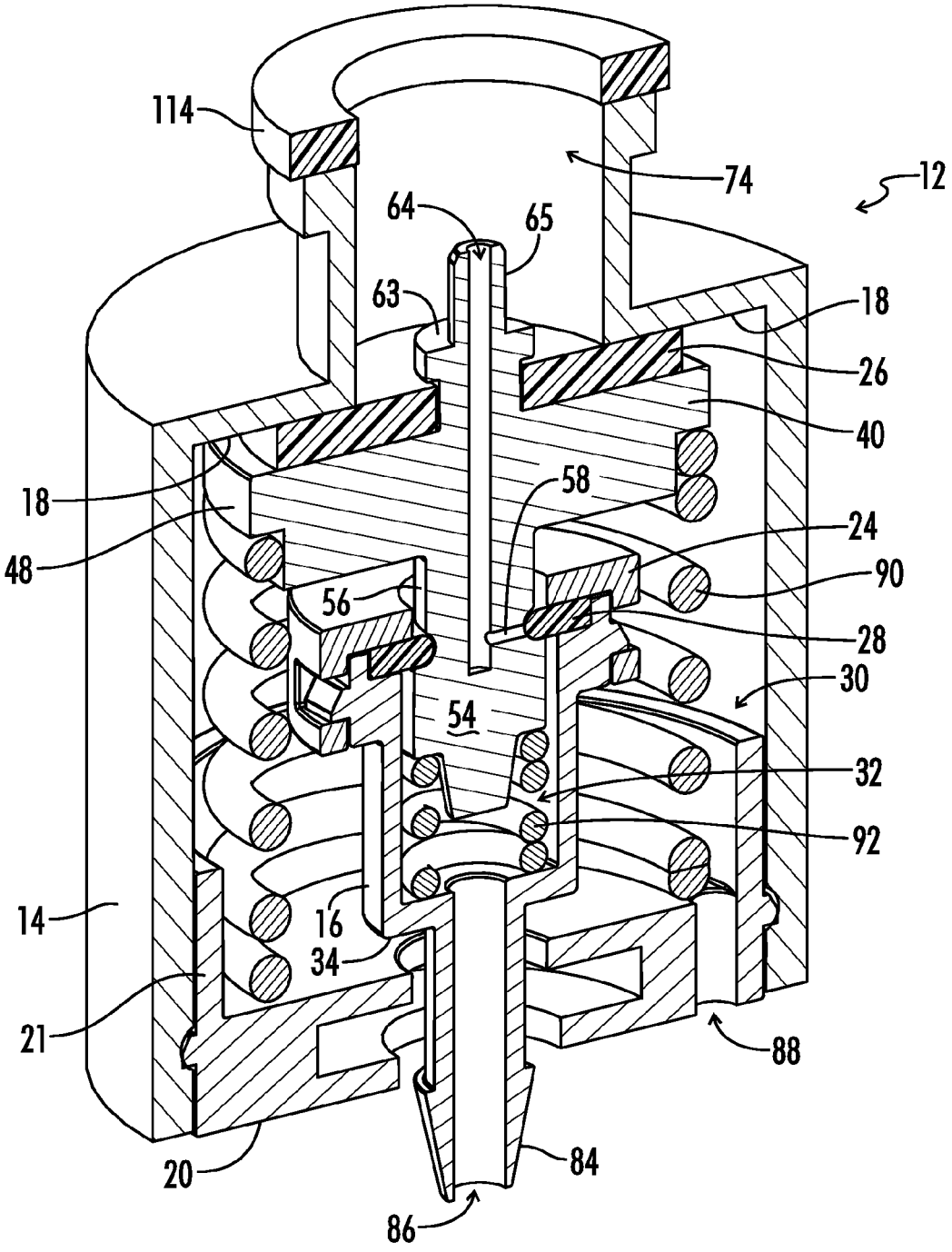
FIG. 6 illustrates a partial cross-sectional view of an embodiment of a sequential delivery valve in a closed position in accordance with the present disclosure.

Referring to FIG. 6, Gas port 88 is generally open to a primary chamber 30 disposed in valve 12. Primary chamber 30 is defined by a primary housing 14 including a primary housing wall that encloses primary chamber 30. In some embodiments, primary chamber 30 is formed by attaching a primary housing 14 to a primary housing cap 20. Primary housing cap 20 includes a disk-shaped cap that closes off an open end of primary housing 14. As seen in FIG. 6, in some embodiments, primary housing cap 20 may be inserted into an end opening in primary housing 14 in a snap fit engagement, including one or more flanges extending radially from primary housing cap 20 and engaging a corresponding recess in primary housing 14. In other embodiments, primary housing cap 20 may engage primary housing 14 in any suitable engagement such as a threaded engagement, an interference fit, and adhesive engagement, etc. In some embodiments, primary housing cap 20 includes a cap wall 21 that is inserted into primary housing 14 and forms a seal between primary housing 14 and primary housing cap 20. Gas that enters valve 12 through gas port 88 fills primary chamber 30.

Primary chamber 30 is closed at its lower end by primary housing cap 20. At the opposite end, primary chamber 30 includes a primary chamber opening 74. Primary chamber opening 74 is partially blocked by a primary seal 26 in some embodiments. Primary seal 26 includes a substantially flat annular seal and generally engages primary housing end wall 18 in some embodiments. Primary seal 26 forms a gas-tight seal between primary chamber end wall 18 and primary seal 26 such that gas stored in primary chamber 30 may not pass freely between primary seal 26 and primary chamber end wall 18 when primary seal 26 engages primary chamber end wall 18. Additionally, when primary seal 26 engages primary chamber end wall 18, gas cannot freely travel through primary chamber 30 into primary housing exit 74.

Referring further to FIG. 6, liquid port 86 is generally open to a secondary chamber 32 defined by a secondary housing 16. Secondary housing 16 includes a secondary housing wall that encloses secondary chamber 32. Secondary housing 16 includes a generally cylindrical shape in some embodiments, as seen in FIG. 6. Secondary chamber 30 is open at one axial end to liquid port 86 formed in secondary chamber housing 16. At the opposite axial end, secondary chamber 30 includes an open secondary chamber end corresponding to an opening in secondary chamber housing 16. A secondary seal 28 spans the opening in secondary housing 16. Secondary seal 28 may be held in place by a secondary housing cap 24. Secondary housing cap 24 includes a disk-shaped member that snaps onto secondary housing 16 in some embodiments. Secondary housing cap 24 may secure secondary seal 28 in place. Secondary seal 28 forms a substantially flat, annular seal in some embodiments.

Also seen in FIG. 6, a pusher 40 is disposed in primary chamber 30. Pusher 40 is axially moveable in valve 12 in some embodiments. Pusher 40 may include a unitary, axisymmetric member having a pusher bore 64. Pusher bore 64 forms a channel for the passage of fluid in some embodiments. Pusher 40 generally includes at its upper end a pusher bore fitting 65 open to pusher bore 64. Pusher bore fitting 65 may be attached to dispensing head 104. Thus, when dispensing head 104 is manually depressed via actuator 118, a corresponding downward motion is caused in pusher 40.

A pusher disk 48 extends radially outwardly from pusher 40 below pusher bore fitting 65. Pusher disk 48 generally forms an upper pusher disk surface. Primary seal 26 may rest against pusher disk 48 and particularly against upper pusher disk surface when valve 12 is in a closed position. A primary spring 90 is disposed between pusher 40 and primary housing cap 20 in some embodiments. Primary spring 90 includes a compression coil spring in some embodiments. Primary spring 90 may engage the underside of pusher disk 48, as seen in FIG. 6. In some embodiments, a pusher disk recess is defined on the underside of pusher disk 48 for accommodating the inner diameter of primary spring 90. Primary spring 90 biases pusher 40 toward primary housing end wall 18 such that primary seal 26 engages primary housing end wall 18 on one side and engages pusher disk on the other side.

Pusher 40 also includes a pusher shaft 56 extending below pusher disk 48. Pusher shaft 56 generally includes a smaller diameter than pusher disk 48. Pusher shaft 56 generally extends downward into secondary chamber 32. Pusher shaft 56 extends through a central hole in secondary seal 28. A pusher shaft groove 60, seen in FIG. 5, forms a recess extending radially inwardly around pusher shaft 56 near secondary seal 28. A portion of secondary seal 28 extends into the pusher shaft groove 60.

A pusher port 58 is defined in pusher 40 extending radially through a portion of pusher shaft 56 near the pusher shaft groove 60. Pusher port 58 is generally open to pusher bore 64 at one end and open to pusher shaft groove 60 at the opposite end. Thus, when secondary seal 28 is seated in the pusher shaft groove 60, pusher port 58 is closed. A pusher head 54, seen in FIG. 5, extends below pusher shaft groove 60 and is housed in secondary chamber 32 in some embodiments.

Pusher shaft 56 together with secondary seal 28 blocks the open end of secondary chamber 32. Thus, when liquid enters secondary chamber 32 via liquid port 86, the liquid may fill secondary chamber 32 but cannot pass through secondary chamber 32 when pusher port 58 is closed by secondary seal 28.

During operation, a user may manually depress dispensing head 104 and cause valve 12 to open. Valve 12 generally has three positions. Normally, when dispensing head 104 is not depressed, valve 12 is in a closed position, and no liquid or gas travels through valve 12. When valve 12 is in the closed position, primary seal 26 engages primary housing 14. When valve 12 is in the closed position, pusher 40 is biased upwardly toward primary housing end wall 18 by primary spring 90.

Pusher 40 may be axially displaced away from primary housing end wall 18 such that primary seal 26 disengages from primary housing end wall 18, causing valve 12 to become partially opened. As seen in FIG. 6, in some embodiments, a pusher bore fitting flange 63 may be disposed between pusher bore fitting 65 and primary seal 26 extending radially from pusher 40. Pusher bore fitting flange 63 prevents primary seal 26 from moving axially relative to pusher 40 when dispensing head 104 is manually depressed. In the partially open position, valve 12 allows gas to pass through valve 12 into primary housing exit 74. In some embodiments, valve 12 may be partially opened by manually pressing dispensing head 104, thereby causing dispensing head 104 to axially translate pusher 40 relative to primary housing 14. An embodiment of a dispensing device 100 showing a valve 12 in a partially open position is seen in FIG. 4. In this embodiment in the partially open position, actuator 118 of dispensing head 104 is pressed only a fraction of its maximum downward travel range. As seen in FIG. 4, primary seal 26 is separated from primary housing end wall 18. Thus, gas may enter primary chamber 30 through gas port 88, flow through primary chamber 30 toward dispenser head 104, travel through the space between primary seal 26 and primary housing end wall 18, and enter a gas duct 122 formed in actuator 118 on dispenser head 104. Gas duct 122 may be integrally formed in actuator 118 in some embodiments. Gas duct 122 forms a channel through actuator 118 and is open at one end to primary housing exit 74.

Gas stored in container 102 is generally held under pressure higher than atmospheric pressure such that once valve 12 becomes partially opened, the pressurized gas will begin to flow toward and through gas duct 122. If the force applied to actuator 118 on dispensing head 104 is released, primary spring 90 will bias pusher 40 back toward primary housing end wall 18 and cause primary seal 26 to re-engage primary housing end wall 18, thereby stopping the flow of gas into primary housing exit 74 and gas duct 122.

In some applications, the pressure of gas stored in container 102 may be high enough to cause gas to flow through gas duct 122 at an undesirably high flow rate and pressure when valve 12 becomes partially opened. To control the flow rate and pressure of gas through gas duct 122, a flow restrictor 126 may be disposed in gas duct 122. Flow restrictor 126 includes a tubular member having a central restrictor bore. The central restrictor bore has a smaller diameter than the gas duct inner diameter. As such, gas travelling through gas duct 122 must pass through flow restrictor 126. The ratio of the diameter of the central restrictor bore to the inner diameter of the gas duct will determine the pressure drop across the flow restrictor and the resulting flow rate through the gas duct 122. Flow restrictor 126 may be secured in gas duct 122 in an interference fit in some embodiments.

As seen in FIG. 4, when valve 12 is partially open, pusher port 58 is blocked by secondary seal 28. As such, liquid may not travel through secondary chamber 32 when valve 12 is in a partially open position.

Generally, in some embodiments, when pusher 40 is displaced axially downwardly, other parts in valve 12 undergo corresponding displacement inside primary chamber 30. For example, in some embodiments, when pusher 40 is moved axially away from primary housing end wall 18, other features inside primary chamber 30 including secondary housing 16, secondary housing cap 24, secondary seal 28, and secondary spring 92 also move downward inside primary chamber 30.

A secondary housing seal 38, seen in FIG. 3, may be disposed between primary housing cap 20 and liquid port fitting 84. In some embodiments, secondary housing seal 38 engages a portion of liquid tube 36 or liquid port fitting 84 that extends partially into primary chamber 30 through an opening in primary housing cap 20. Secondary housing seal 38 may include an inner diameter slightly smaller than the outer diameter of liquid tube 36 such that the portion of liquid tube 36 disposed about liquid port fitting 84 engages secondary housing seal 38 in a sliding interference fit. As such, secondary housing seal 38 provides a gas-tight seal to prevent gas from leaking from primary chamber 30 when secondary housing 16 translates axially following motion of pusher 40.

Referring further to FIG. 3 and FIG. 4, valve 12 attains a partially open position when pusher 40 is axially displaced away from primary housing end wall 18. However, pusher 40 together with secondary housing 16 may translate over a given axial range before secondary housing 16 engages primary housing cap 20. More specifically, referring to FIG. 4 and FIG. 6, after pusher 40 is translated over a first axial range corresponding to partially open positions, secondary housing shoulder 34 advances toward and eventually contacts primary housing cap 20. Primary housing cap 20 is secured to primary housing 14 and thus does not move when engaged by secondary housing shoulder 34. As such, when secondary housing 16 contacts primary housing cap 20, axial movement of secondary housing 16 and secondary housing cap 24 stops.

Valve 12 may be described as attaining a partially open configuration upon movement of pusher 40 from a first position where primary seal 26 disengages primary housing end wall 18 to a second position where secondary housing shoulder 34 engages primary housing cap 20.

Figure 5:
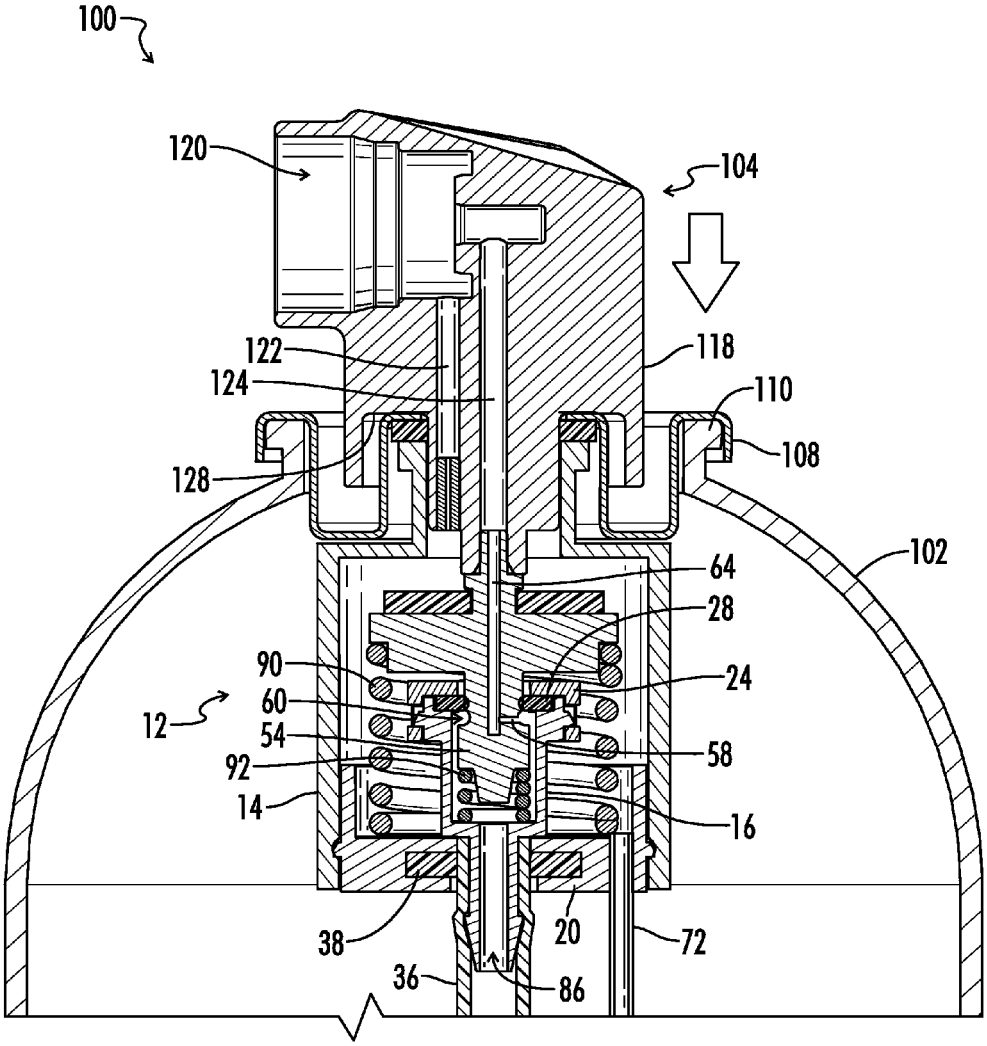
FIG. 5 illustrates a detail partial cross-sectional view of the embodiment of a dispensing device of FIG. 1 showing a sequential delivery valve in a fully open position.

Referring now to FIG. 5, in some embodiments, valve 12 may become fully opened by translating pusher 40 even further away from primary housing end wall 18 from the position seen in FIG. 4 such that pusher 40 begins to translate axially relative to secondary housing 16. More specifically, in some embodiments, a portion of pusher 40 at the lower end of pusher shaft 56 includes a pusher head 54. Pusher head 54 is housed in secondary chamber 32. After secondary housing shoulder 34 engages primary housing cap 20, further downward displacement of pusher 40 causes pusher head 54 to axially translate inside secondary chamber 32 such that pusher head 54 moves axially relative to secondary housing 16.

Pusher shaft groove 60 may include a ramped upper edge. In some embodiments, secondary seal 28 is fixed to secondary housing 16 and may not continue to move axially downwardly after secondary housing 16 engages and is stopped by primary housing cap 20. As such, pusher 40 may translate relative to secondary seal 28. When pusher 40 translates axially downwardly relative to secondary seal 28 and secondary housing 16, the ramped upper edge of pusher shaft groove 60 may slidably engage and radially compress secondary seal 28. As such, secondary seal 28 may become temporarily dislodged from pusher shaft groove 60, thereby opening pusher port 58 to secondary chamber 32. When pusher port 58 becomes opened to secondary chamber 32, valve 12 becomes fully opened and liquid may: (1) enter valve 12 through liquid tube 36, (2) pass through liquid port 86, (3) enter secondary chamber 32, (4) travel through secondary chamber 32 around pusher head 54 and into pusher port 58, (5) enter and travel through pusher bore 64 toward liquid duct 124, and (6) enter liquid duct 124 on actuator 118 of dispenser head 104 for ejection from the dispensing device.

The downward stroke of pusher 40 is stopped in some embodiments when a structure on dispensing head 104 engages a structure on container 102. In some embodiments, an actuator shoulder 128 is positioned above collar 108 when valve 12 is in a closed position, as seen in FIG. 3. As actuator 118 is pressed downward, actuator shoulder 128 advances toward collar 108. However, actuator 118 is dimensioned such that actuator shoulder 128 does not engage collar 108 until valve 12 attains a fully opened position, as seen in FIG. 5. When actuator shoulder 128 engages collar 108, downward travel of actuator 118 and pusher 40 is stopped. In some embodiments, as seen in FIG. 5, fluid may continue to flow through secondary chamber 32 on valve 12 even when downward travel of pusher 40 is stopped via engagement between actuator 118 and collar 108. Thus, when dispenser head 104 is fully depressed, valve 12 is in a fully open position and both liquid and gas may travel through valve 12 and into dispenser head 104.

It is noted that in other embodiments, downward travel of pusher 40 may be stopped by other structural features such as components within valve 12. For example, in some embodiments, pusher disk 48 may engage the top of secondary housing cap 24 to stop downward travel of pusher 40. In other embodiments, pusher head 54 may engage secondary housing 16 to stop both downward travel of pusher 40 and flow of liquid from liquid port 86 into secondary chamber 32.

In various applications, it is generally desirable to provide a dispenser device 100 capable of releasing stored propellant gas into the dispenser head before allowing stored liquid product to enter the dispensing head. By initiating gas flow prior to liquid flow, the gas flow may operate to clear any occlusions or other debris in the dispensing head downstream of the valve 12 prior to liquid ejection from valve 12.

Similarly, it is desirable in many applications to terminate ejection of the atomized spray by first terminating emission of the liquid from the valve and subsequently terminating emission of the gas flow from the valve. Allowing the gas to flow from the valve through the dispensing head after the liquid flow has been shut off will clear the dispensing head of leftover liquid that might otherwise clog the dispensing head. This sequential valve operation reduces the likelihood that residual liquid will settle in the dispensing head and clog the device.

To achieve sequential delivery of first gas and then liquid to the dispensing head, and corresponding sequential termination of first liquid and then gas flows to the dispensing head, a sequential delivery valve is provided. In some embodiments, the present disclosure provides a sequential delivery valve, 12, seen for example in an embodiment in FIG. 6. In additional embodiments, the present disclosure provides a dispensing device 100 including a sequential delivery valve 12.

During use, a user may manually depress the dispensing head 104 in the actuation direction to initiate a spray of the liquid product from the dispensing head. The dispensing head 104 in some embodiments includes at least three axial positions, or axial position ranges, along the actuation direction. A first axial position is illustrated in FIG. 3. In the first axial position, the dispensing head is at its farthest position from the container and the valve 12 is in the closed position. When the dispensing head is at the first axial position, both the primary chamber 30 and the secondary chamber 32 are blocked from being in fluid communication with the dispensing head. Thus, gas cannot enter the dispensing head from the primary chamber 30, and liquid cannot enter the dispensing head from the secondary chamber 32.

From the first axial position, the dispensing head may be depressed to a second axial position, or range of second axial positions, nearer the container than the first axial position, as seen for example in FIG. 4. Through the second axial position range, the valve is partially opened and the primary chamber 30 enters fluid communication with the dispensing head, allowing gas stored in the primary chamber 30 to enter the dispensing head 104. However, when the dispensing head is in a second axial position of the second axial position range, the secondary chamber 32 is not in fluid communication with the dispensing head 104. If the dispensing head is depressed even further beyond a second axial position, the dispensing head travels to a third axial position, or third axial position range, as seen in FIG. 5, wherein the valve 12 becomes fully opened and both the primary chamber 30 and the secondary chamber 32 enter fluid communication with the dispensing head 104, thereby allowing both gas and liquid to enter dispensing head 104. When the dispensing head 104 is in a third axial position and valve 12 is fully opened, the liquid product stored in the container may travel through the dispensing head and out of the nozzle for application or use.

Following delivery of a desired amount, or dose, through the valve 12, the user may release the applied force on the dispensing head 104. Due to primary and secondary springs 90, 92 housed in valve 12, the dispensing head 104 will be biased away from the container 102 and will return toward the first axial position. As the dispensing head returns toward the first axial position, the dispensing head will necessarily pass through the second axial position range at which time the secondary chamber 32 will cease to be in fluid communication with the dispensing head 104. As this occurs, fluid flow through secondary chamber 32 into dispensing head 104 will stop, however gas flow through primary chamber 30 will continue until the dispensing head 104 reaches the first axial position and primary seal 28 re-engages primary housing 14.

Figure 7:
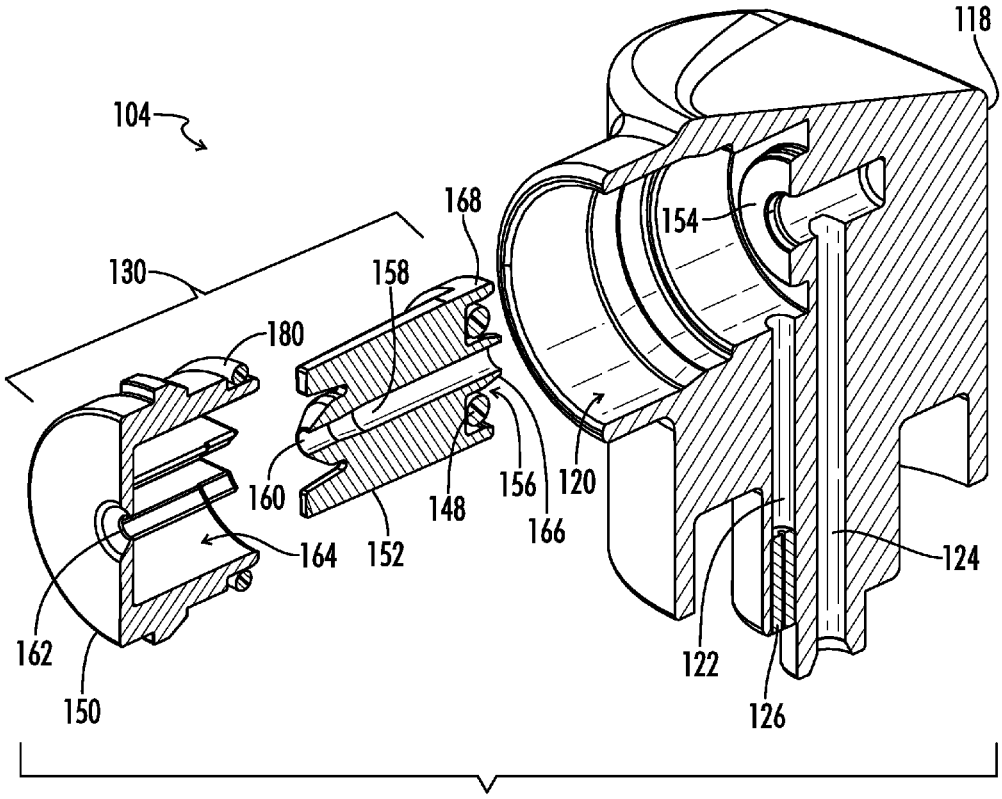
FIG. 7 illustrates an exploded perspective partial cross-sectional view of an embodiment of a dispensing head in accordance with the present disclosure.

In some applications, it is generally desirable to provide a modular dispensing head 104 that includes an actuator 118 and a nozzle insert 130, seen in FIG. 7. A nozzle insert 130 generally includes a structure that can be attached to the actuator 118 through which a liquid product to be dispensed travels prior to ejection from the dispensing head 104. The nozzle insert 130 may include a particular geometry for achieving desired characteristics of an atomized spray, such as droplet size, spray range, etc. By providing a modular dispensing head 104, it is possible to use one actuator 118 design interchangeably for different spray applications on different dispensing devices by including different nozzle inserts 130. In some embodiments, one or more pieces of the dispensing head 104 may be removable for replacement or cleaning.

Nozzle insert 130 can be configured to produce a spray with desired characteristics. In some embodiments, nozzle insert 130 is configured to provide a violent, or turbulent interaction between a gas propellant travelling through dispensing head 104 and a liquid product travelling through dispensing head 104. A violent interaction may result in turbulent mixing between the gas and the liquid prior to ejection from the dispensing head and may result in production of an atomized spray having uniformly sized particles in a desired size range.

Referring to FIG. 7, in some embodiments, nozzle insert 130 includes a pressure cap 150 and a liquid conduit 152. Pressure cap 150 generally includes a cylindrical-shaped tube substantially closed at one end. Pressure cap 150 defines an interior void that forms a pressure chamber 164. Pressure chamber 164 receives gas from gas duct 122 on actuator 118 when pressure cap 150 is installed in actuator socket 120.

Figure 10:
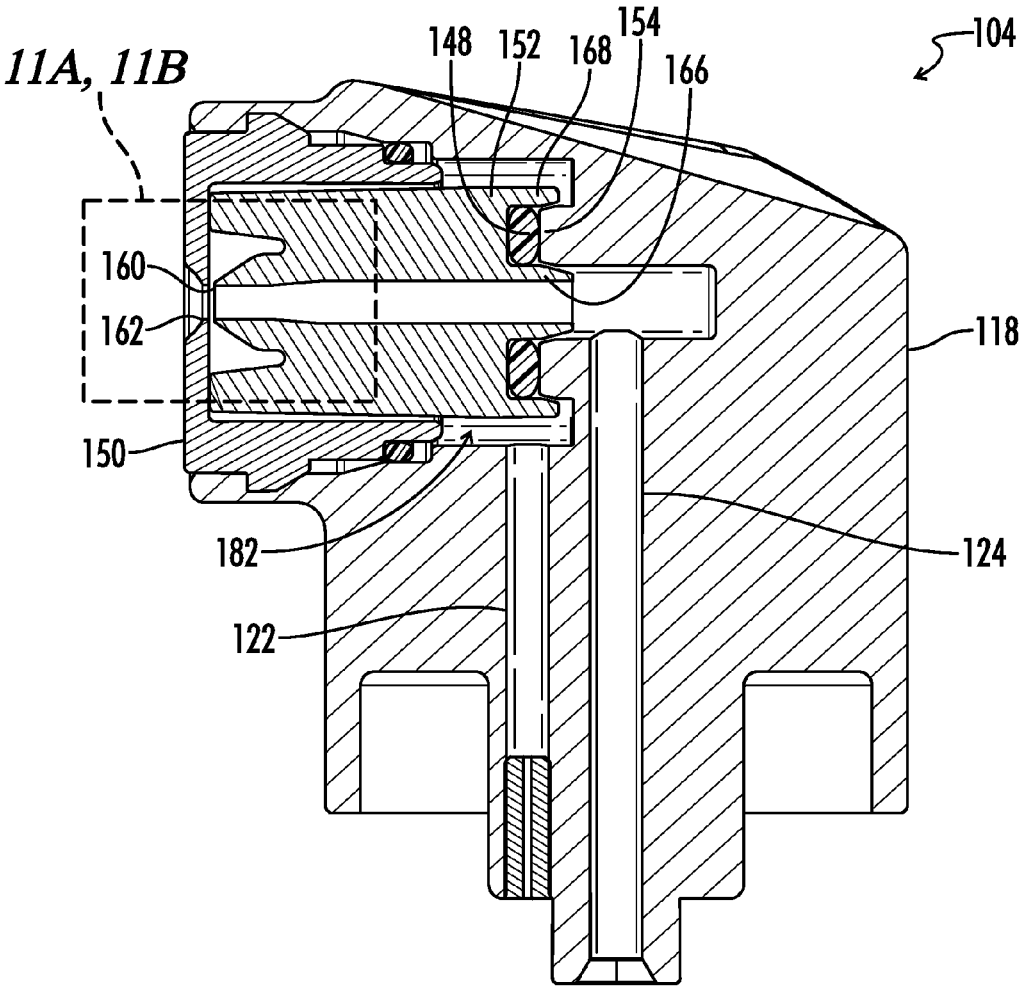
FIG. 10 illustrates a partial cross-sectional view of an embodiment of a dispensing head including a nozzle insert in accordance with the present disclosure.

A pressure chamber exit orifice 162 is defined on the distal end of pressure cap 150. The distal end of pressure cap 150 is located on the end of pressure cap 150 positioned away from actuator 118. As seen in FIG. 7 and FIG. 10, in some embodiments, pressure cap 150 fits in actuator socket 120 such that gas entering actuator socket 120 via gas duct 122 will fill pressure chamber 164 prior to being emitted from pressure chamber 164 through pressure chamber exit orifice 162.

A pressure cap seal 180 is disposed around the outer perimeter of pressure cap 150 and is positioned between actuator 118 and pressure cap 150 when pressure cap 150 is installed in actuator socket 120. Pressure cap seal 180 may include an annular sealing ring such as an o-ring in some embodiments. Pressure cap 150 may provide a recessed region wherein pressure cap seal 180 is seated so that pressure cap seal 180 does not inadvertently roll axially along pressure cap 150 when pressure cap 150 is inserted into actuator socket 120.

Figure 9:
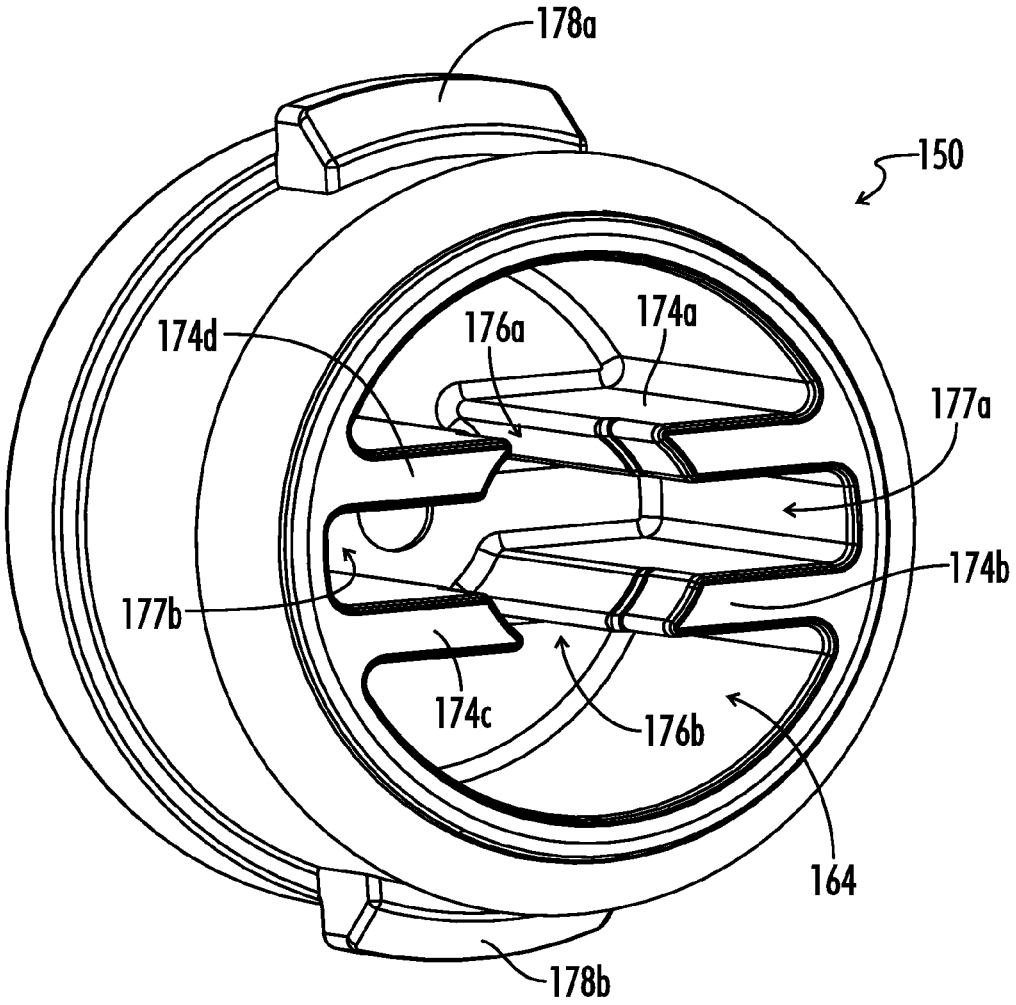
FIG. 9 illustrates a perspective view of an embodiment of a pressure cap of the dispensing head of FIG. 7.

As seen in FIG. 9, in some embodiments, pressure cap 150 includes one or more cap flanges 178*a*, 178*b* extending radially from pressure cap 150. Each cap flange 178*a*, 178*b* may engage a corresponding groove or recess defined in actuator 118 for securing pressure cap 150 in actuator socket 120. In some embodiments, other means may be used to secure pressure cap 150 in actuator socket 120, such as but not limited to a threaded engagement or an adhesive.

Referring again to FIG. 7 and FIGS. 8A and 8B, in some embodiments, nozzle insert 130 also includes a liquid conduit member 152 disposed between pressure cap 150 and actuator 118. Liquid conduit 152 provides a channel for allowing liquid product to travel from liquid duct 124 toward pressure chamber exit orifice 162 for emission from dispensing head 104. As seen in FIG. 7, liquid conduit 152 includes a conduit nipple 166 that fits partially into liquid duct 124. In some embodiments, a portion of actuator 118 surrounding the opening of liquid duct 124 open to actuator socket 120 forms a crown 154. Conduit nipple 166 fits in the interior of crown 154 in an interference fit in some embodiments. As such, an interference seal is formed between liquid conduit 152 and actuator 118.

A liquid supply channel 158 is formed axially through liquid conduit 152. Liquid supply channel 158 extends through nipple 166 and is open at one end to liquid duct 124. Liquid supply channel 158 includes a liquid supply channel exit opening 160 at the opposite end open to pressure chamber 164. As such, liquid travelling through liquid duct 124 will enter directly into liquid supply channel 158 of liquid conduit 152.

Figure 8A:
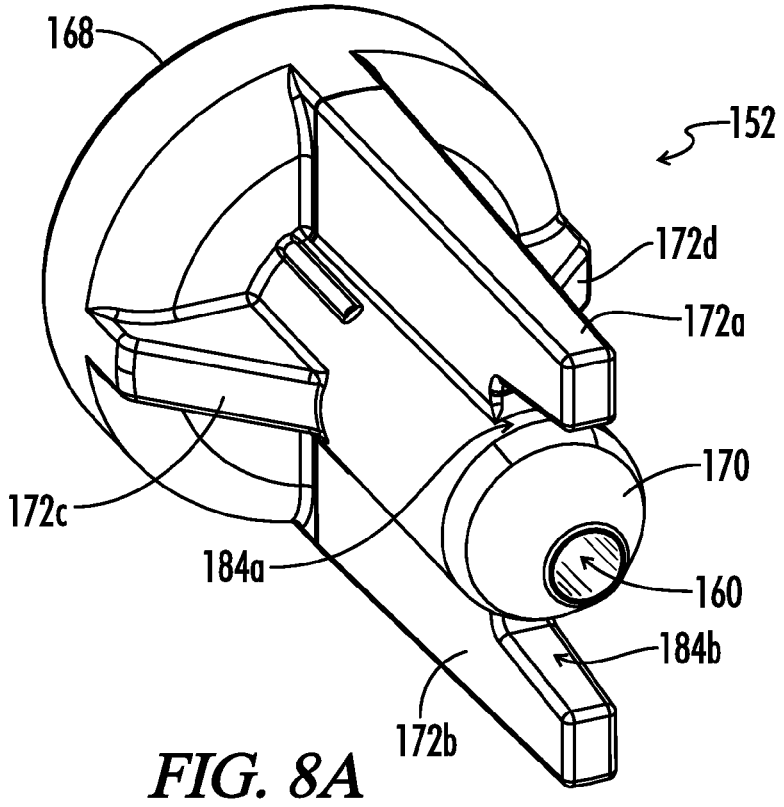
FIG. 8A illustrates a perspective view of an embodiment of a liquid conduit member of the dispensing head of FIG. 7.
Figure 8B:
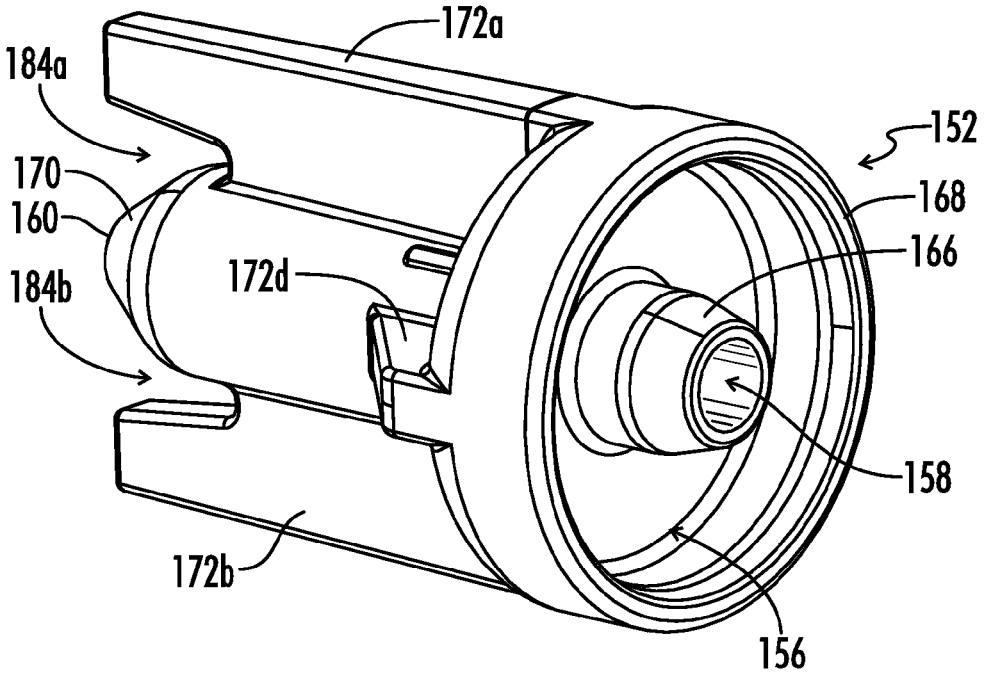
FIG. 8B illustrates a perspective view of the embodiment of the liquid conduit member of FIG. 8A.

Also seen in FIG. 7 and FIGS. 8A and 8B, in some embodiments, a conduit base 168 forms a hoop surrounding nipple 166, wherein a conduit recess 156 is defined annularly between nipple 166 and conduit base 168. In some embodiments, crown 154 is received in conduit recess 156 when liquid conduit 152 is installed in actuator socket 120. A crown seal 148 is disposed in conduit recess 156 and forms a seal between liquid conduit 152 and crown 154 when liquid conduit 154 is installed in actuator socket 120. Crown seal 148 in some embodiments includes an O-ring. Conduit base 168 may provide a radial clamping force against crown 154 to secure liquid conduit 152 in actuator socket 120 in some embodiments. As seen in FIG. 10, when liquid conduit 152 is installed on actuator 118, a conduit gap 182 is defined between the opening of gas duct 122 in actuator socket 120 and the lower edge of liquid conduit 152. As such, liquid conduit 152 does not block gas flow from gas duct 122. As such, gas may exit gas duct 122, enter pressure chamber 164 and travel around liquid conduit 152 toward pressure chamber exit orifice 162.

In some alternative embodiments, liquid conduit 152 is integrally formed as part of actuator 118 and provides an integral liquid supply channel 158 extending toward pressure chamber exit orifice 162 on pressure cap 150.

Referring to FIGS. 8A, 8B and FIG. 9, in some embodiments, it is generally desirable to provide an engagement between liquid conduit 152 and pressure cap 150 to maintain consistent positioning between pressure cap 150 and liquid conduit 152. In some applications, desired characteristics of an atomized spray emitted from pressure chamber exit orifice 162 can only be achieved when a precise geometry between liquid conduit 152 and pressure cap 150 is maintained. To ensure precise positioning, in some embodiments, a plurality of conduit flanges may extend radially from liquid conduit 152. For example, first and second conduit flanges 172*a*, 172*b* may extend radially from substantially opposite sides of liquid conduit 152. Each conduit flange 172*a*, 172*b* includes a substantially flat projection that extends to a radial distance at or near the maximum outer dimension of liquid conduit 152. In the event that liquid conduit 152 becomes dislodged or displaced inside pressure cap 150, a first or second conduit flange 172*a*, 172*b* would engage the inner pressure cap wall to prevent further displacement of liquid conduit 152, thereby maintaining a desired geometry between liquid conduit 152 and pressure cap 150 for achieving desired spacing between fluid supply channel exit opening 160 and pressure chamber exit orifice 162.

Additionally, as seen in FIG. 9, in some embodiments, pressure cap 150 includes a plurality of cap ribs protruding into pressure chamber 164. For example, first and second cap ribs 174*a*, 174*b* extend from a first side of the interior of pressure cap 150, and third and fourth cap ribs 174*c*, 174*d* extend from a second side of the interior of pressure cap 150 opposite the first and second cap ribs 174*a*, 174*b*. A first rib gap 176*a* is generally defined between first and fourth cap ribs 174*a*, 174*b*. First conduit flange 172*a* may extend upwardly through first rib gap 176*a* between first and fourth cap ribs 174*a*, 174*d* when pressure cap 150 and liquid conduit 152 are installed in actuator socket 120. Similarly, a second rib gap 176*b* is generally defined between second and third cap ribs 174*b*, 174*c*. Second conduit flange 172*b* may extend downwardly through second rib gap 176*b* between second and third cap ribs 174*b*, 174*c* when pressure cap 150 and liquid conduit 152 are installed in actuator socket 120.

Referring further to FIG. 8A and FIG. 8B, in some embodiments, third and fourth conduit flanges 172*c*, 172*d* also extend from liquid conduit 152 radially outwardly on substantially opposite sides of liquid conduit 152 between first and second conduit flanges 172*a*, 172*b*. Third and fourth conduit flanges 172*c*, 172*d* do not extend axially as far toward fluid supply channel exit opening 160 as first and second conduit flanges 172*a*, 172*b*. Third and fourth conduit flanges 172*c*, 172*d* extend to a radial distance at or near the maximum outer dimension of liquid conduit 152 in some embodiments. Third and fourth conduit flanges 172*c*, 172*d* may engage one or more cap ribs 174 disposed on pressure cap 150 to provide consistent alignment between pressure cap 150 and liquid conduit 152. For example, in some embodiments, third conduit flange 172*c* fits in a first rib groove 177*a* defined between first and second cap ribs 174*a*, 174*b* on pressure cap 150. Similarly, fourth conduit flange 172*d* fits in a second rib groove 177*b* defined between third and fourth cap ribs 174*a*, 174*b* on pressure cap 150. Also, in some embodiments, third and fourth conduit flanges 172*c*, 172*d* may include a tapered, or ramped, forward end to facilitate insertion of third and fourth conduit flanges 172*c*, 172*d* into corresponding rib grooves on pressure cap 150.

Referring further to FIG. 8A and FIG. 8B, in some embodiments, liquid conduit 152 includes a tapered conduit distal end 170. In some embodiments, tapered conduit distal end 170 includes the shape of a frustrated cone terminating in fluid supply channel exit opening 160. In some applications, it is desirable to have gas flowing around the complete outer perimeter of liquid conduit 152 axially and radially toward pressure supply channel exit opening 160. To achieve unobstructed circumferential axial gas flow toward pressure supply channel exit opening 160, a first flange gap 184*a* is defined between first conduit flange 172*a* and tapered conduit distal end 170. Similarly, a second flange gap 184*b* is defined between second conduit flange 172*b* and tapered conduit distal end 170. First and second flange gaps 184*a*, 184*b* allow first and second flanges 172*a*, 172*b* to extend to the axial end of liquid conduit 152 without blocking gas flow circumferentially around tapered conduit distal end 170.

Dispensing head 104 and nozzle insert 130 may be configured in some embodiments to achieve a flow phenomenon known as flow blurring. Flow blurring requires the nozzle insert to be fed with a liquid flow and pressurized gas stream through separated channels, eventually mixing near the nozzle exit and generating a desired spray.

A flow blurring nozzle insert is defined as a nozzle insert configured to generate a flow blurring interaction between a propellant gas and a liquid product near the nozzle exit. During flow blurring, liquid product 190 travels through liquid supply channel 152 toward liquid supply channel exit opening 160 at a controlled liquid flow rate and liquid pressure, and gas propellant 188 travels through pressure chamber 164 toward pressure chamber exit orifice 162 at a controlled gas flow rate and gas pressure. The liquid and gas flows interact between the liquid supply channel exit opening 160 and the pressure chamber exit opening 162, forming an atomized spray.

Figure 11A:
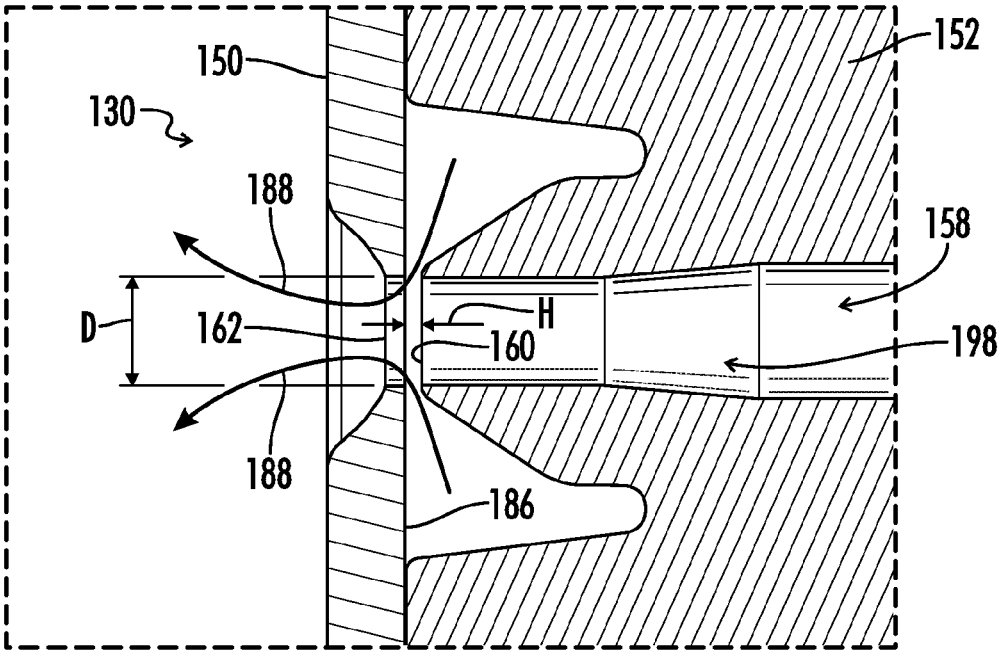
FIG. 11A illustrates a detail cross-sectional view of an embodiment of a nozzle insert of Section 11-11 of FIG. 10 in accordance with the present disclosure.
Figure 11B:
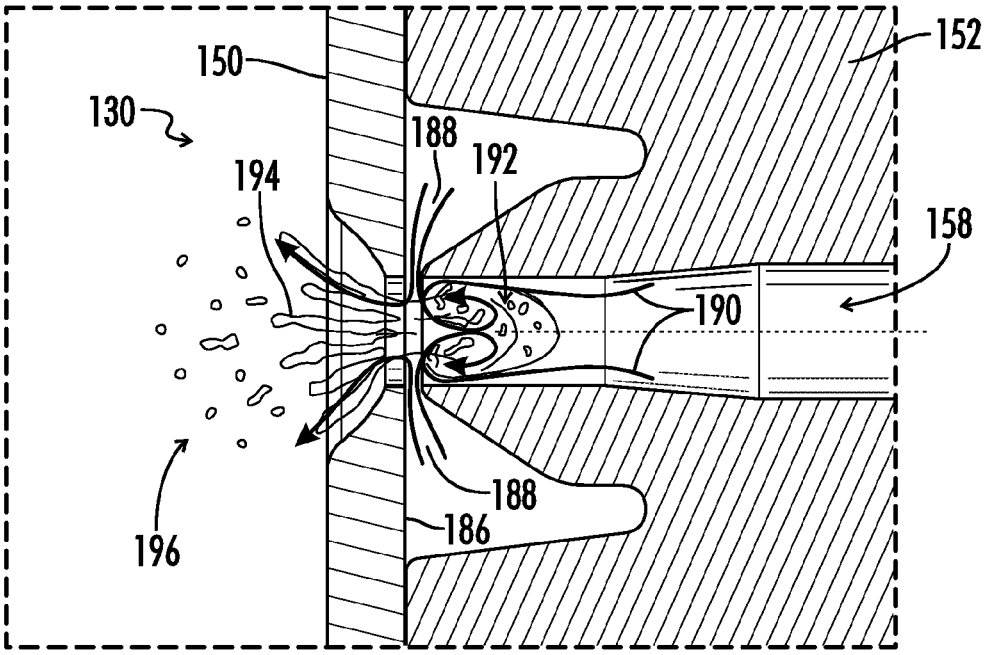
FIG. 11B illustrates a detail cross-sectional view of an embodiment of a nozzle insert including a gas flow and a liquid flow forming a reflux cell in the liquid supply channel.

As seen in FIG. 11A and 11B, in some embodiments, nozzle insert 130 includes a pressure cap 150 including an interior pressure cap end wall 186 substantially facing toward pressure chamber 164. Pressure cap end wall 186 can be substantially flat in some embodiments. Interior pressure cap end wall 186 is axially offset from the liquid supply channel exit opening 160 by a distance H. Pressure chamber exit orifice 162 includes a pressure chamber exit orifice diameter D. In some embodiments, a nozzle insert 130 including a ratio of H divided by D less than about 0.25 creates a flow blurring nozzle insert. In various other embodiments, a nozzle insert 130 including a ratio of H divided by D less than about 0.10 creates a flow blurring nozzle insert.

Referring to FIG. 11A and 11B, in some embodiments, each conduit flange 172*a*, 172*b* includes a distal end that extends beyond liquid supply channel exit opening 160. In some embodiments, each conduit flange 172*a*, 172*b* extends beyond liquid supply channel exit opening 160 by a distance substantially equal to H. As such, the distal end of each conduit flange 172*a*, 172*b* may engage pressure chamber interior end wall 186 when liquid conduit 152 and pressure cap 150 are installed on the dispensing head. When the distal end of each conduit flange 172*a*, 172*b* is configured to engage the pressure chamber interior end wall 186, a uniform distance H between fluid supply exit opening 160 and pressure chamber interior end wall 186 adjacent pressure chamber exit opening may be maintained, thereby providing a desired flow interaction geometry for forming a reflux cell in liquid supply channel.

In some embodiments, a flow blurring nozzle insert 130 allows a portion of gas forced through pressure chamber 164 from gas duct 122 to flow upstream into liquid supply channel 158 through liquid supply channel exit opening 160 and to form a reflux cell with the liquid product in liquid supply channel 158 upstream of liquid supply channel exit opening 160. Formation of reflux cell 192 is characteristic of a flow blurring interaction between a liquid product and a propellant gas. Reflux cell 192 includes a region of toroidal vorticity between propellant gas flow 188 and liquid product flow 190 inside liquid supply channel 158. The liquid and gas undergo turbulent flow interactions, forming one or more discrete bubbles of propellant gas in some flow conditions. A plurality of fluid ligaments 194 may be formed extending from reflux cell 192 toward pressure chamber exit orifice 162, and a plurality of atomized droplets 196 are formed downstream of pressure chamber exit orifice 162. The dispenser head 104 or nozzle insert 130 may form atomized droplets 196 in a size range of between about 0.5 and about 100 micrometers in some applications.

As seen in FIG. 11A, in some embodiments, liquid supply channel 158 includes a converging section 198 upstream of the liquid supply channel exit opening 160. The converging section 198 generally provides a reduction in diameter in a downstream direction toward the liquid supply channel exit opening 160.

It is understood, that in other embodiments, dispensing device 100 or dispenser head 104 may include a nozzle insert 130 having a geometry that does not produce flow blurring.

In some embodiments, the dispensing head, including the actuator, the liquid conduit and the pressure cap are formed by injection molding.

In additional embodiments, the present disclosure provides a method of ejecting an atomized spray of a gas propellant and a liquid product from a dispensing head on a dispensing device. The method includes the steps of: (a) providing an actuator having a liquid duct, a gas duct and an actuator socket; (b) providing a pressure cap disposed in the axial socket, the pressure cap forming a pressure chamber between the pressure cap and the actuator and including a pressure chamber exit orifice defined in the pressure cap, wherein the pressure chamber is in fluid communication with the gas duct; (c) providing a liquid conduit member in the pressure chamber between the pressure cap and the actuator, the liquid conduit member including a liquid supply channel defined therein, the liquid supply channel including a liquid supply channel axis and including a liquid supply channel exit opening substantially aligned with the pressure chamber exit orifice; (d) supplying a flow of liquid through the liquid supply channel toward the liquid supply channel exit opening; (e) supplying a flow of a gas from the gas duct through the pressure chamber toward the liquid supply channel axis between the liquid supply channel exit opening and the pressure chamber exit orifice, wherein the gas intercepts the flow of liquid, travels upstream toward the liquid supply channel exit opening and enters the liquid supply channel exit opening; (f) forming a reflux cell inside the liquid supply channel upstream of the liquid supply channel exit opening, wherein the liquid and the gas undergo turbulent mixing in the reflux cell; and (g) ejecting the liquid from the reflux cell through the pressure chamber exit orifice. The method may also includes the step of breaking the liquid up into a plurality of atomized liquid droplets.

The present disclosure also provides a method of emitting a liquid product from a dispensing device, comprising: (a) providing a dispensing device having a container storing the liquid and the gas and including a dispensing head and a sequential delivery valve attached to the container; (b) depressing the dispensing head toward the container from a first axial position to a second axial position, thereby partially opening the valve and allowing gas to pass through the valve from the container into the dispensing head, and blocking liquid from passing through the valve from the container into the dispensing head; (c) depressing the dispensing head further toward the container from the second axial position to a third axial position nearer the container than the second axial position, thereby fully opening the valve and allowing both gas and liquid to pass though the valve from the container into the dispensing head; and (d) emitting the liquid and the gas from the dispensing head. In some embodiments, the method also includes the step of turbulently mixing the liquid and the gas in a reflux cell inside the dispensing head.

Thus, although there have been described particular embodiments of the present invention of new and useful nozzle insert for a dispensing head atomizer and associated methods, it is not intended that such references be construed as limitations upon the scope of this invention except as set forth in the following claims.

What is claimed is:

1. A dispensing head apparatus for ejecting an atomized spray from a container, comprising:

an actuator including a liquid duct, a gas duct, and an actuator socket defined in the actuator, the actuator socket being in fluid communication with the gas duct;

a liquid conduit disposed in the actuator socket, the liquid conduit including a liquid supply channel in fluid communication with the liquid duct at one end and forming a liquid supply channel exit opening at the opposite end such that liquid travelling from the liquid duct toward the liquid supply channel exit opening passes through the liquid supply channel;

a pressure cap disposed in the actuator socket, the pressure cap defining a pressure chamber between the pressure cap and the actuator, the pressure chamber being in fluid communication with the gas duct;

a pressure chamber exit orifice defined in the pressure cap downstream of the of the liquid supply channel exit opening such that gas passing from the gas duct toward the pressure chamber exit orifice travels past the liquid supply channel exit opening;

a plurality of conduit flanges protruding substantially radially outwardly from the liquid conduit;

first and second cap ribs extending from the pressure cap inwardly toward the liquid conduit, the first and second cap ribs defining a first rib groove therebetween; and wherein a first one of the plurality of conduit flanges is received in the first rib groove.

2. The apparatus of claim 1, further comprising:

the pressure cap including an interior pressure cap end wall, wherein the interior pressure cap end wall is axially offset from the liquid supply channel exit opening by a distance H, wherein the pressure chamber exit orifice includes a pressure chamber exit orifice diameter D, and wherein the ratio of H divided by D is less than about 0.25.

3. The apparatus of claim 2, wherein:

the ratio of H divided by D is less than about 0.1.

4. The apparatus of claim 1, wherein:

the pressure cap and liquid conduit are configured such that gas entering the pressure chamber from the gas duct flows around the exterior of the liquid conduit and out the pressure chamber exit orifice, and the pressure cap and liquid conduit are configured such that liquid entering the liquid supply channel from the liquid duct flows through the liquid supply channel and exits the liquid supply exit opening.

5. The apparatus of claim 4, wherein:

the pressure cap and liquid conduit are configured such that a liquid and gas reflux cell is formed in the liquid supply channel when a liquid is forced through the liquid supply channel toward the liquid supply channel exit opening and a gas is forced through the pressure chamber toward the pressure chamber exit orifice.

6. The apparatus of claim 1, further comprising:

a flow restrictor disposed in the gas duct.

7. The apparatus of claim 1, further comprising:

third and fourth cap ribs extending from the pressure cap inwardly toward the liquid conduit, the third and fourth cap ribs defining a second rib groove therebetween, wherein a second one of the plurality of conduit flanges is received in the second rib groove.

8. The apparatus of claim 1, further comprising:

at least one cap flange extending radially outwardly from the pressure cap, wherein the at least one cap flange engages the actuator for securing the pressure cap in the actuator socket.

9. The apparatus of claim 1, further comprising:

the liquid supply channel including a converging section upstream of the liquid supply channel exit opening.

10. The apparatus of claim 1, further comprising:

the liquid supply channel exit opening including a liquid supply channel exit opening diameter; and the pressure chamber exit orifice including a pressure chamber exit orifice diameter, wherein the liquid supply channel exit opening and the pressure chamber exit orifice diameter are substantially the same.

11. The apparatus of claim 1, wherein the pressure cap and the liquid conduit are formed by injection molding.

12. The apparatus of claim 1, further comprising an annular cap seal disposed between the pressure cap and the actuator.

13. A nozzle insert apparatus for insertion into an actuator on a dispenser head on a fluid product dispensing device, comprising:

a pressure cap defining an interior pressure chamber, the pressure cap including an interior pressure chamber end wall disposed at an axial end of the pressure cap and including a pressure chamber exit orifice defined in the interior pressure chamber end wall, the pressure chamber exit orifice having a diameter D;

a liquid conduit disposed in the pressure chamber, the liquid conduit including an axial liquid supply channel defined through the liquid conduit, the liquid supply channel terminating at a liquid supply channel exit opening;

an axial gap defined between the liquid supply channel exit opening and the interior pressure chamber end wall such that the liquid supply channel exit opening is axially offset from the interior pressure chamber end wall by an axial distance H, wherein the ratio of H divided by D is less than about 0.25;

a plurality of conduit flanges extending substantially radially outwardly from the liquid conduit, wherein at least one conduit flange engages the pressure cap; and a plurality of cap ribs extending from the pressure cap into the pressure chamber, wherein at least one of the plurality of conduit flanges engages at least one of the plurality of cap ribs.

14. A method of ejecting an atomized spray of a liquid product and a gas propellant from a dispensing head on a dispensing device, comprising:

(a) providing an actuator having a liquid duct, a gas duct and an actuator socket;

(b) providing a pressure cap disposed in the actuator socket, the pressure cap forming a pressure chamber between the pressure cap and the actuator and including a pressure chamber exit orifice defined in the pressure cap, wherein the pressure chamber is in fluid communication with the gas duct;

(c) providing a liquid conduit in the pressure chamber between the pressure cap and the actuator, the liquid conduit including a liquid supply channel defined therein, the liquid supply channel including a liquid supply channel axis and including a liquid supply channel exit opening substantially aligned with the pressure chamber exit orifice;

(d) supplying a flow of liquid through the liquid supply channel toward the liquid supply channel exit opening;

(e) supplying a flow of a gas from the gas duct through the pressure chamber toward the liquid supply channel axis between the liquid supply channel exit opening and the pressure chamber exit orifice, wherein the gas intercepts the flow of liquid, travels upstream toward the liquid supply channel exit opening and enters the liquid supply channel exit opening;

(f) forming a reflux cell inside the liquid supply channel upstream of the liquid supply channel exit opening, wherein the liquid and the gas undergo turbulent mixing in the reflux cell; and (g) ejecting the liquid from the reflux cell through the pressure chamber exit orifice.

15. The method of claim 14, further comprising breaking the liquid up into a plurality of atomized liquid droplets.

* * * * *